US007849992B2

(12) United States Patent
Seo et al.

(10) Patent No.: US 7,849,992 B2
(45) Date of Patent: Dec. 14, 2010

(54) BILL DEPOSIT MACHINE

(75) Inventors: Yoshimasa Seo, Himeji (JP); Yoshikazu Mitsusada, Himeji (JP)

(73) Assignee: Glory Kogyo Kabushiki Kaisya, Himelji-Shi (JP)

( * ) Notice: Subject to any disclaimer, the term of this patent is extended or adjusted under 35 U.S.C. 154(b) by 0 days.

(21) Appl. No.: 10/301,717

(22) Filed: Nov. 22, 2002

(65) Prior Publication Data

US 2003/0094402 A1 May 22, 2003

(30) Foreign Application Priority Data

Nov. 22, 2001 (JP) ..... 2001-356887

(51) Int. Cl.
*G07F 7/04* (2006.01)

(52) U.S. Cl. ..... 194/206; 902/8

(58) Field of Classification Search ..... 194/206, 194/207; 209/534; 271/262–265, 265.04; 902/8, 9, 11–13, 16

See application file for complete search history.

(56) References Cited

U.S. PATENT DOCUMENTS

| | | | | |
|---|---|---|---|---|
| 4,447,714 | A * | 5/1984 | Lundblad | 235/379 |
| 4,473,157 | A | 9/1984 | Hirose et al. | |
| 4,696,426 | A | 9/1987 | Decker et al. | |
| 4,726,474 | A | 2/1988 | Arikawa et al. | |
| 4,733,765 | A | 3/1988 | Watanabe | |
| 5,695,038 | A * | 12/1997 | Keith et al. | 194/206 |
| 5,897,114 | A | 4/1999 | Arikawa et al. | |
| 6,019,209 | A | 2/2000 | Hara et al. | |
| 6,273,413 | B1 * | 8/2001 | Graef | 271/3.14 |
| D451,145 | S * | 11/2001 | Taxon | D20/8 |
| 6,315,194 | B1 * | 11/2001 | Graef et al. | 235/379 |
| 6,682,068 | B1 * | 1/2004 | Haney et al. | 271/228 |

FOREIGN PATENT DOCUMENTS

| | | |
|---|---|---|
| CN | 1162159 | 10/1997 |
| EP | 0 185 862 A2 | 7/1986 |
| EP | 0 473 106 A2 | 3/1992 |
| EP | 0 837 431 A2 | 4/1998 |
| EP | 0 932 129 A2 | 7/1999 |
| EP | 0 936 580 A2 | 8/1999 |
| EP | 0 994 445 A2 | 4/2000 |
| EP | 0 994 445 A3 | 4/2000 |
| JP | 60-131077 U | 9/1985 |
| JP | 10-181922 A | 7/1998 |

* cited by examiner

*Primary Examiner*—Jeffrey A Shapiro
(74) *Attorney, Agent, or Firm*—Birch, Stewart, Kolasch & Birch, LLP

(57) ABSTRACT

A bill deposit machine comprising: a deposit/return port for accepting and returning a batch of bills, a bill transport path for transporting the batch of bills accepted at said deposit/return port with the wide dimension of the bills parallel to the transport path horizontally and in a straight line, a feed-out section for feeding out the bills, one at a time, out of the batch of bills received from said bill transport path, a discriminating unit for discriminating if the bills fed out of said feed-out section can be deposited or not, and a bill returning path for transporting the rejected bills, which are determined by said discriminating unit as being unable to be deposited, to said bill transport path. Bills are projected and kept to be projected out of said deposit/return port by the specified amount by said bill conveying device when the movement of the bills which are being taken out of said deposit/return port is detected by said takeout detecting device.

7 Claims, 16 Drawing Sheets

BILL DEPOSIT MACHINE

This nonprovisional application claims priority under 35 U.S.C. §119(a) on Patent Application No. 2001-356887 filed in Japan on Nov. 22, 2001, which is herein incorporated by reference.

BACKGROUND OF THE INVENTION

1. Field of the Invention

This invention relates to a bill deposit machine used in automatic teller machines, money-changing machines, etc.

2. Description of the Related Art

There is disclosed a bill deposit machine used in automatic teller machines, money-changing machines, etc. in Japanese Examined Patent Publication (Koukoku) No. 63-19916. In the machine, a batch of bills is inserted into a deposit inlet by a customer. A feed-out section feeds out the bills, one at a time, out of the inserted batch of the bills. A discriminating unit determines if the bill fed out can be deposited or not. The bill determined as being able to be deposited is stored in a temporary storage. The bill stored in a temporary storage is stored in a safe if it is approved by the customer. On the other hand, the rejected bills determined by the discriminating unit as being unable to be deposited are transported to a return outlet and returned to the customer by way of the return outlet.

In the above-mentioned bill deposit machine, as the deposit inlet and the return outlet were disposed separately and the mechanical strength of the area between the deposit inlet and the return outlet was not so high, the said area was sometimes broken by a bar, etc. inserted in the deposit inlet or the return outlet, with the result that the bills inside the machine were stolen.

In view of such a problem, a method of handling bills is proposed, that is, a bill deposit machine to be accommodated inside a safe, and bills to be inputted and outputted through a single opening located on the wall of the safe.

SUMMARY OF THE INVENTION

An object of the present invention is to provide a bill deposit machine with improved burglarproof features by following a method of handling bills to be inputted and outputted through a single opening at the same time with the steady transportation of bills. Another object of the present invention is to provide a bill deposit machine which can keep the bills to be returned until they are received by the customer. A further object of the present invention is to provide a bill deposit machine which assures a smooth depositing process without accepting a batch of bills over the maximum permissible limit in thickness.

In order to achieve the above-mentioned object, the present invention is characterized by the following features. That is, the present invention is a bill deposit machine comprising: a deposit/return port for accepting and returning a batch of bills; a bill transport path for transporting the batch of bills accepted at said deposit/return port with the wide dimension of the bills parallel to the transport path horizontally and in a straight line; a feed-out section for feeding out the bills, one at a time, out of the batch of bills received from said bill transport path; a discriminating unit for discriminating if the bills fed out of said feed-out section can be deposited or not; and a bill returning path for transporting the rejected bills, which are determined by said discriminating unit as being unable to be deposited, to said bill transport path; wherein the bills are inputted and outputted by way of said deposit/return port. According to this feature, the bill deposit machine accommodated inside a safe is used with only the deposit/return port facing the outside of the safe through an opening located on a wall of the safe. Therefore, this makes it extremely difficult to break the machine and steal the bills, which means that the machine is highly burglarproof. In addition, the bill transport path which transports the bills inserted from the deposit/return port to the feed-out section is designed to transport a batch of bills or a bill with the wide dimension of the bills parallel to the transport path horizontally and in a straight line. Therefore, the batch of bills is not curved, moreover, since the area on the batch of bills contacted with a transport mechanism is large, the bills are not easily separate from each other in the direction of transportation during transportation, enabling steady transportation.

Furthermore, in the present invention, a rejected bill collecting section is disposed on the way at said bill transport path to accumulate and temporarily store said rejected bills. According to this feature, the bills to be rejected can be returned together after the batch of bills is accepted at the deposit/return port.

Furthermore, in the present invention, a temporary storage for temporarily storing the bills, which are determined by said discriminating unit as being able to be deposited, is disposed. The bills in said temporary storage are transported to said rejected bill collecting section when depositing transaction is cancelled. According to this feature, even the bills determined by the discriminating unit as being able to be deposited can be returned to the customer together with the rejected bills if the said bills are stopped from being deposited by the customer.

Furthermore, in the present invention, said rejected bill collecting section, said feed-out section, said transport path for bills to be returned and said bill transport path are disposed in a loop. According to this feature, the main elements can be disposed compactly in a rational manner.

Furthermore, in the present invention, the rejected bills in said rejected bill collecting section are re-transported to said feed-out section to be discriminated by said discriminating unit. This feature enables the low probability of rejecting the bills which can be deposited. This reduces the labor of re-inserting the rejected bills by the customer into the deposit/return port to be discriminated once again.

Furthermore, the present invention is also characterized by the following features. That is, the present invention is a bill deposit machine comprising: a deposit/return port for accepting and returning a batch of bills; a bill transport path for transporting the batch of bills accepted at said deposit/return port; a feed-out section for feeding out the bills, one at a time, out of the batch of bills received from said bill transport path; a discriminating unit for discriminating if the bills fed out of said feed-out section can be deposited or not; a bill returning path for transporting the rejected bills, which are determined by said discriminating unit as being unable to be deposited, to said bill transport path; a bill conveying device disposed at said deposit/return port; and a thickness detecting device for detecting the thickness of the batch of bills inserted into said deposit/return port; wherein the batch of bills is not taken in by said bill conveying device if it is detected to be over the specified value in thickness by said thickness detecting device. According to this feature, the bill deposit machine can prevent the batch of bills from falling like dominoes and spreading on the bill transport path as the result of the intake of the excessively thick batch of bills.

Furthermore, the present invention is characterized by the following features. That is, the present invention is a bill deposit machine comprising: a deposit/return port for accepting and returning a batch of bills; a bill transport path for transporting the batch of bills accepted at said deposit/return port; a feed-out section for feeding out the bills, one at a time, out of the batch of bills received from said bill transport path; a discriminating unit for discriminating if the bills fed out of said feed-out section can be deposited or not; a bill returning path for transporting the rejected bills, which are determined by said discriminating unit as being unable to be deposited, to said bill transport path; a bill conveying device disposed at said deposit/return port; and a takeout detecting device for detecting the movement of the bills which are being taken out of said deposit/return port. When the movement of the bills which are being taken out of said deposit/return port is detected by said takeout detecting device, said bills are projected and kept to be projected from said deposit/return port by the specified amount by said bill conveying device. According to this feature, since the bills are projected from the deposit/return port by the specified length by the bill conveying device when they are about to be collected from the deposit/return port by the customer, takeout of the bills is easy. Even if the bills of different lengths are mixed in a batch, they can be surely handed to the customer. As the bills are maintained by the bill conveying device until they are taken out completely by the customer, they will neither drop nor be blown away by the wind.

DESCRIPTION OF THE DRAWINGS

These and other objects, features of the present invention will be more clearly understood by the following description of the preferred embodiments of the invention in conjunction with the accompanying drawings, in which.

DETAILED DESCRIPTION OF THE PRESENT INVENTION

Figure 1:
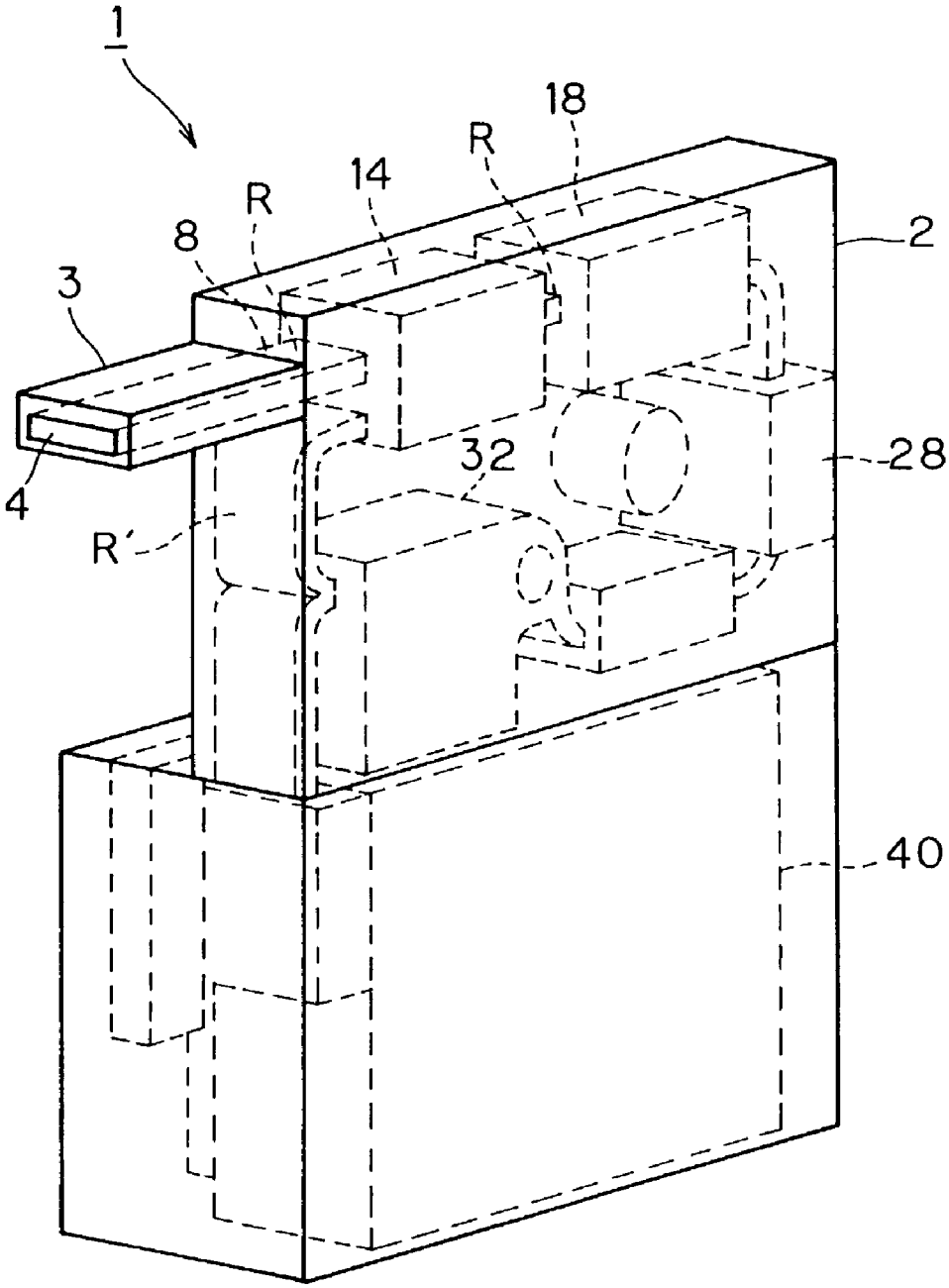
FIG. 1 is a perspective view showing the outline of the bill deposit machine in accordance with the first embodiment of the present invention.

The first embodiment of the present invention will be described by referring to the drawings, FIG. 1-FIG. 10.

As shown in FIG. 1, the bill deposit machine 1 according to the first embodiment has a projection part or projecting portion 3, a rectangular parallelepiped, which projects forward of the upper front face of the main body 2 of the machine. A deposit/return port 4 is disposed at the outer end of the projection part 3 spaced from the main body 2. An inner end of the projecting portion is connected to the main body 2. The deposit/return port 4 is a slot long from side to side, which accepts and returns a batch of a plurality of bills in a stacking manner or a single bill in the direction of the wide dimension of the bills. The bill deposit machine 1 is accommodated inside a safe and the deposit/return port 4 on a tip end of the projecting portion faces the outside of the safe through an opening located on the wall of the safe, which are not illustrated.

Figure 2:
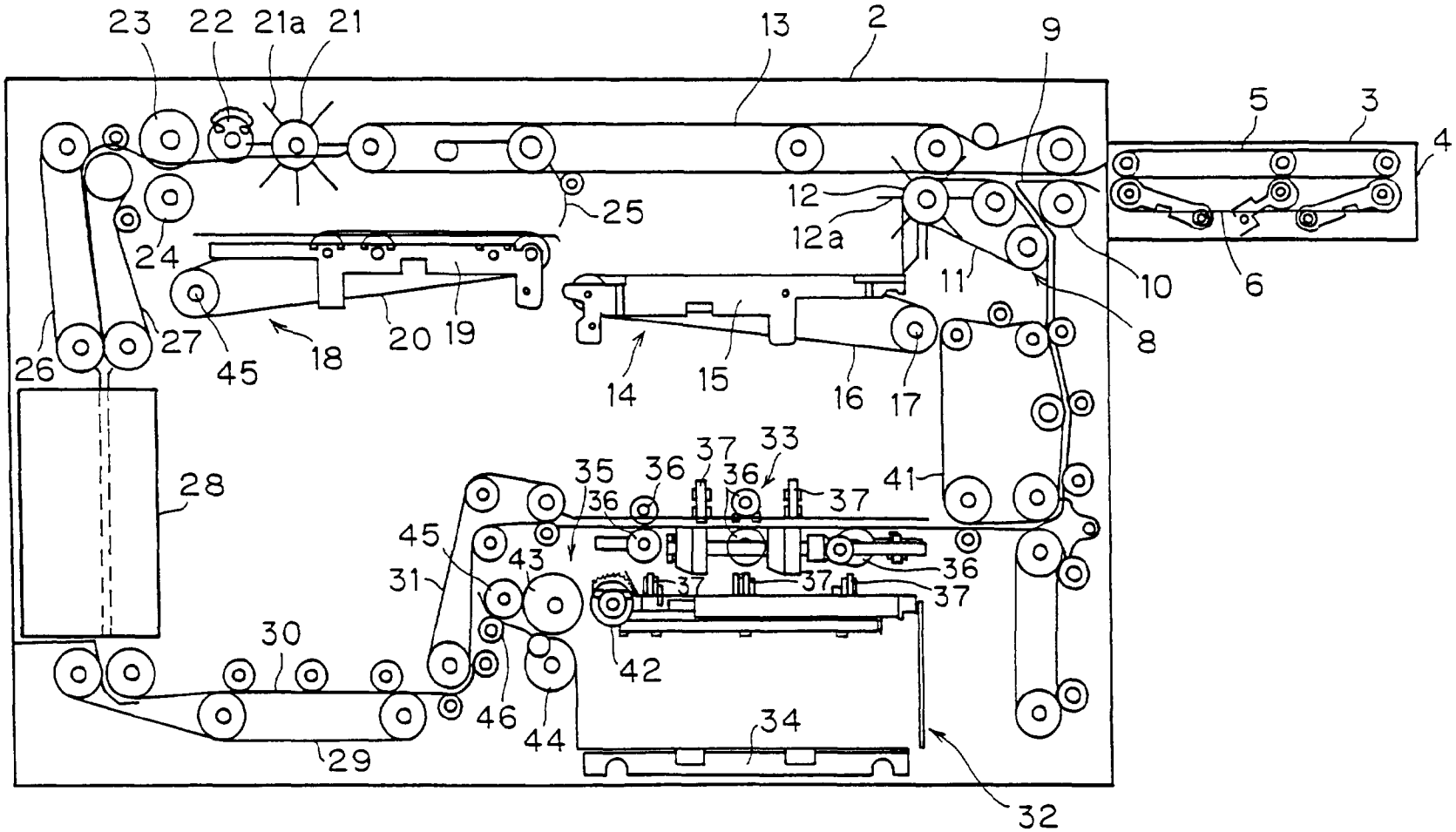
FIG. 2 is a vertical sectional view of said bill deposit machine.

As shown in FIG. 2, inside the projection part 3, transport belts 5 and 6 are arranged to face each other in the upper and lower positions. The lower transport belt 6 can move vertically and can be freely in contact with and separate from the upper transport belt 5. A bill conveying device consists of the transport belts 5 and 6. The batch of bills or a single bill inserted through the deposit/return port 4 is sandwiched between the transport belts 5 and 6 and transported with the wide dimension of the bills parallel to the transport path horizontally and in a straight line.

A batch accepting section 8 is disposed adjacent to the projection part 3 inside the main body 2 of the machine. The batch accepting section 8 has a stage or batch accepting stage 9, a pulley 10, a transport belt 11, an impeller 12, etc., all of which move up and down together.

Above the batch accepting section 8, a transport belt 13 runs in the front and rear direction. The batch accepting section 8 can be freely in contact with and separate from the lower surface of the front end of the transport belt 13. The batch of bills or a single bill transported into the batch accepting section 8 by the transport belts 5 and 6 is supported horizontally by the stage 9 and the transport belt 11, sandwiched between the transport belts 11 and 13 and transported with the wide dimension of the bills parallel to the transport path horizontally and in a straight line.

The impeller 12 has a plurality of vanes 12*a* made of elastic material. The upper face of the rear end of the rejected bills supported by a rejected bill collecting section 14 mentioned later is pressed by the vanes 12*a* so that the succeeding rejected bills can enter the rejected bill collecting section 14 smoothly.

The rejected bill collecting section or rejected bill collecting portion 14 is disposed behind the batch accepting section 8. The rejected bill collecting section 14 has a stage 15, a transport belt 16, etc. below the transport belt 13.

The stage 15 can move up and down and can be freely in contact with and separate from the lower surface of the middle part of the transport belt 13, which serves as a top face of the bill transport path R. The upper surface of the rear end of the transport belt 16 is almost the same in height as the upper surface of the stage 15. When the stage 15 moves up and down between first and second positions as seen, for example, in FIGS. 2-5, the transport belt 16 moves vertically using a shaft 17 located at the front end as a fulcrum and maintains the said state of being almost the same in height. The batch of bills or a single bill transported from the batch accepting section 8 is supported horizontally by the stage 15 and the transport belt 16, sandwiched between the transport belts 13 and 16 and transported with the wide dimension of the bills parallel to the transport path horizontally and in a straight line. When the rejected bill collecting portion is in an upper or first position, bills may be transported along the bill transport path R and when the rejected bill collecting portion is in a lower or second position, bills may be transported from a bill discriminating unit 28 onto the rejected bill collecting portion.

A feed-out section 18 is disposed behind the rejected bill collecting section 14. The feed-out section 18 has a stage 19 and a transport belt 20, both located below the transport belt 13, an impeller 21, a kicker roller 22, a feed roller 23, a reverse roller 24, etc. located behind the transport belt 13.

The stage 19 can move up and down and can be freely in contact with and separate from the lower surface of the rear end of the transport belt 13. The upper surface of the front end of the transport belt 20 is almost the same in height as the upper surface of the stage 19. When the stage 19 moves up and down, the transport belt 20 moves vertically using a shaft 45 located at the rear end as a fulcrum and maintains the said state of being almost the same in height. The batch of bills or a single bill transported from the rejected bill collecting section 14 is supported horizontally by the stage 19 and the transport belt 20, sandwiched between the transport belts 13 and 20 and transported with the wide dimension of the bills parallel to the transport path horizontally and in a straight line.

The impeller 21 has a plurality of vanes 21*a* made of elastic material. The impeller 21 rotates clockwise in the drawing and advances to the opposite side of the customer the only one bill accumulated on the top of the batch supported by the stage 19. The kicker roller 22 and the feed roller 23, which partly have highly frictional areas on each roller surface, rotate clockwise and transport the bills advanced by the impeller 21 to the opposite side of the customer. The reverse roller 24 rotates in the same rotating direction as the feed roller 23 and prevents the bills other than the bill on the top of the batch from being fed out to the opposite side of the customer.

A stopper 25 is disposed between the feed-out section 18 and the rejected bill collecting section 14. The stopper 25 can either project into or retract from the bill transport path R (refer to FIG. 4) consisting of transport belts 5, 6, 11, 13, 16, etc. When the stopper 25 projects into the bill transport path R, it prevents bills from entering the feed-out section 18.

When the batch of bills inserted from the deposit/return port 4 is transported to the rejected bill collecting section 14, a plurality of bills in the batch is sometimes separate from each other in the direction of transportation. The stopper 25 projects into the bill transport path R when the sensor, which is not illustrated, detects the tip of a bill coming. This makes each bill sent into the rejected bill collecting section 14 stop after being transported till the tip of each bill comes in contact with the stopper 25. Thus, the tips of the bills are arranged to be put in the same position so that the separate condition in the direction of transportation can be corrected.

A bill fed out of the feed-out section 18 is sent to a discriminating unit 28 by transport belts 26 and 27 to be discriminated its denomination and genuineness. The result of the determination is stored in the memory of the control means (not illustrated) containing a microcomputer. The bill which passed through the discriminating unit 28 is sent to a temporary storage 32 by transport belts 29-31. The temporary storage 32 has a direction diverting mechanism 33, a stage 34, a feed mechanism 35, etc.

Figure 8:
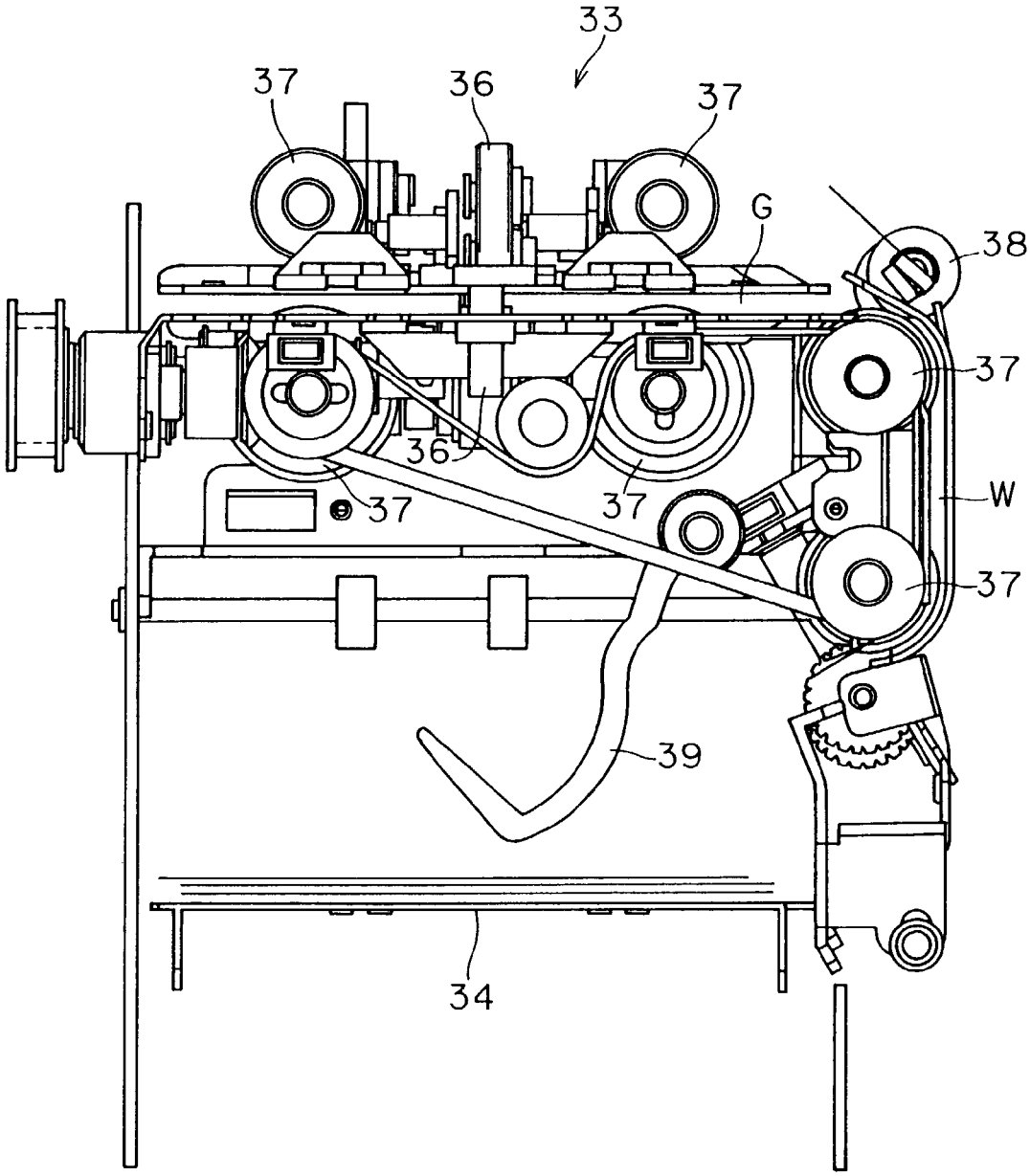
FIG. 8 is a sectional view taken along the line A-A in FIG. 7.

As shown in FIG. 8, the direction diverting mechanism 33 has a wide dimension transport roller 36, a narrow dimension transport roller 37, a driven roller 38, a stopper 39, etc. When a bill is transported from the discriminating unit 28 into an empty space G, the direction diverting mechanism 33 makes the bill transported in a rightward direction in FIG. 8 by the narrow dimension transport roller 37 and passing in a path W if the bill is the one which can be deposited (hereinafter referred to as a normal bill). This makes the bill drop upside down on the stage 34.

The stopper 39 is to press the upper face of the bills placed on the stage 34 so that the bills may not obstruct the succeeding bills to be transported to the stage 34. The bill transported to the stage 34 pushes the stopper 39 up and accumulates on the stage 34. The stage 34 can move up and down. Below the stage 34, a bill storage box 40 (refer to FIG. 1) which is attachable and detachable to the main body 2 of the machine is disposed. When a customer inputs the information of approving the amount of the deposit by the operation panel (not illustrated) of an automatic teller machine etc., the stage 34 slides so that the bills accumulated on the stage 34 can drop into the bill storage box 40.

If a bill is the one which can not be deposited (hereinafter referred to as a rejected bill), the direction diverting mechanism 33 makes the bill transported forward of the main body 2 of the machine (in a rightward direction in FIG. 2) by the wide dimension transport roller 36. The bill is transported to the rejected bill collecting section 14 through a bill returning path R' (refer to FIG. 4) consisting of a transport belt 41, the transport belt 11, etc.

A feed mechanism 35 has a kicker roller 42, a feed roller 43, a reverse roller 44, etc. The kicker roller 42 and the feed roller 43, which partly have highly frictional areas on each roller surface, rotate clockwise. The kicker roller 42 feeds out the bills accumulated on the stage 34 one at a time from the top of the batch. The bills fed out by a kicker roller 42 are transported to the place between transport rollers 45 and 46 by the feed roller 43. The reverse roller 44 rotates reversely only for a period in the latter half of the rotating period while the feed roller 43 is rotating, and prevents the succeeding bills from being caught.

Figure 3:
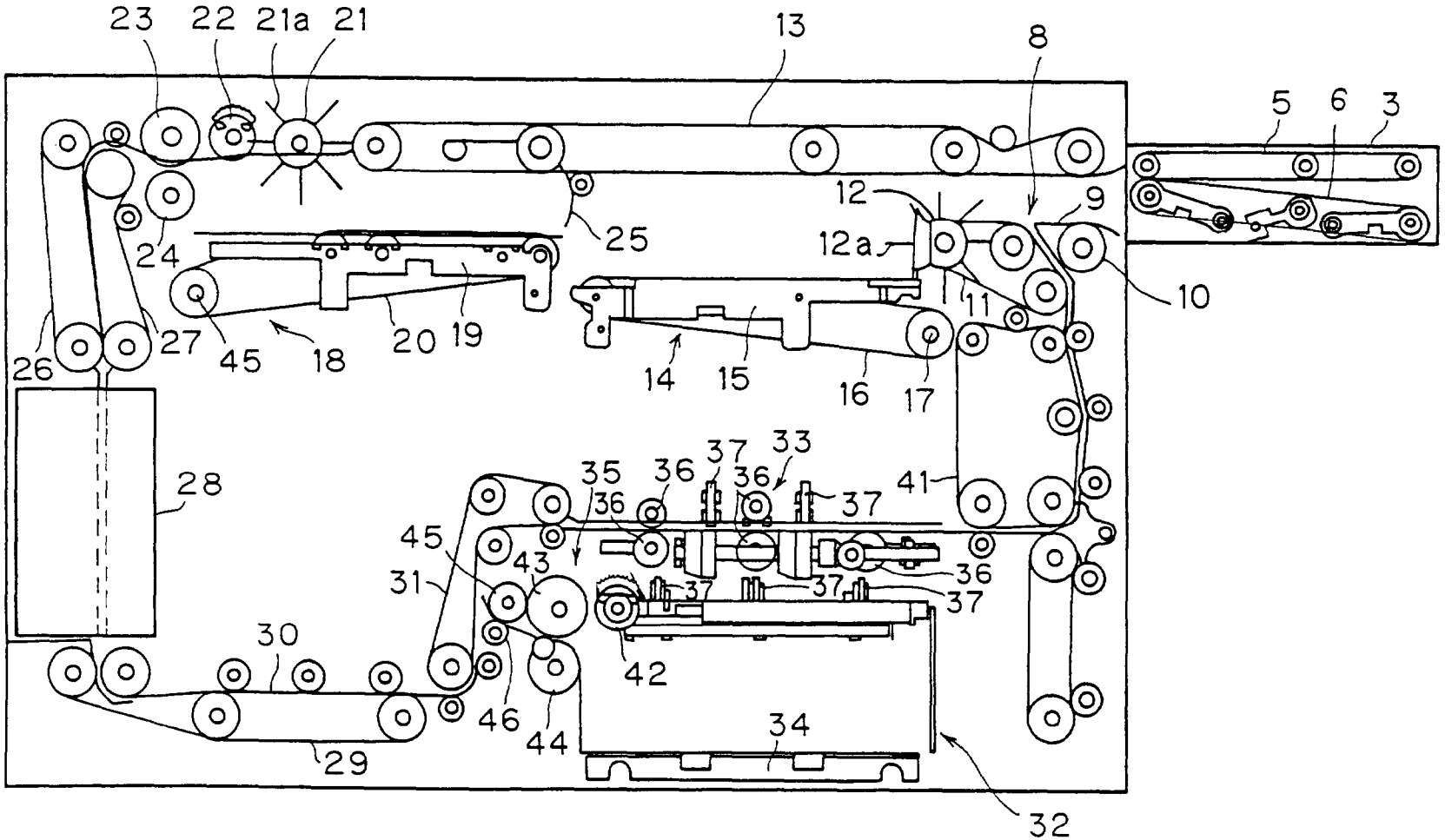
FIG. 3 is another vertical sectional view of said bill deposit machine showing the condition of a different motion.
Figure 9:
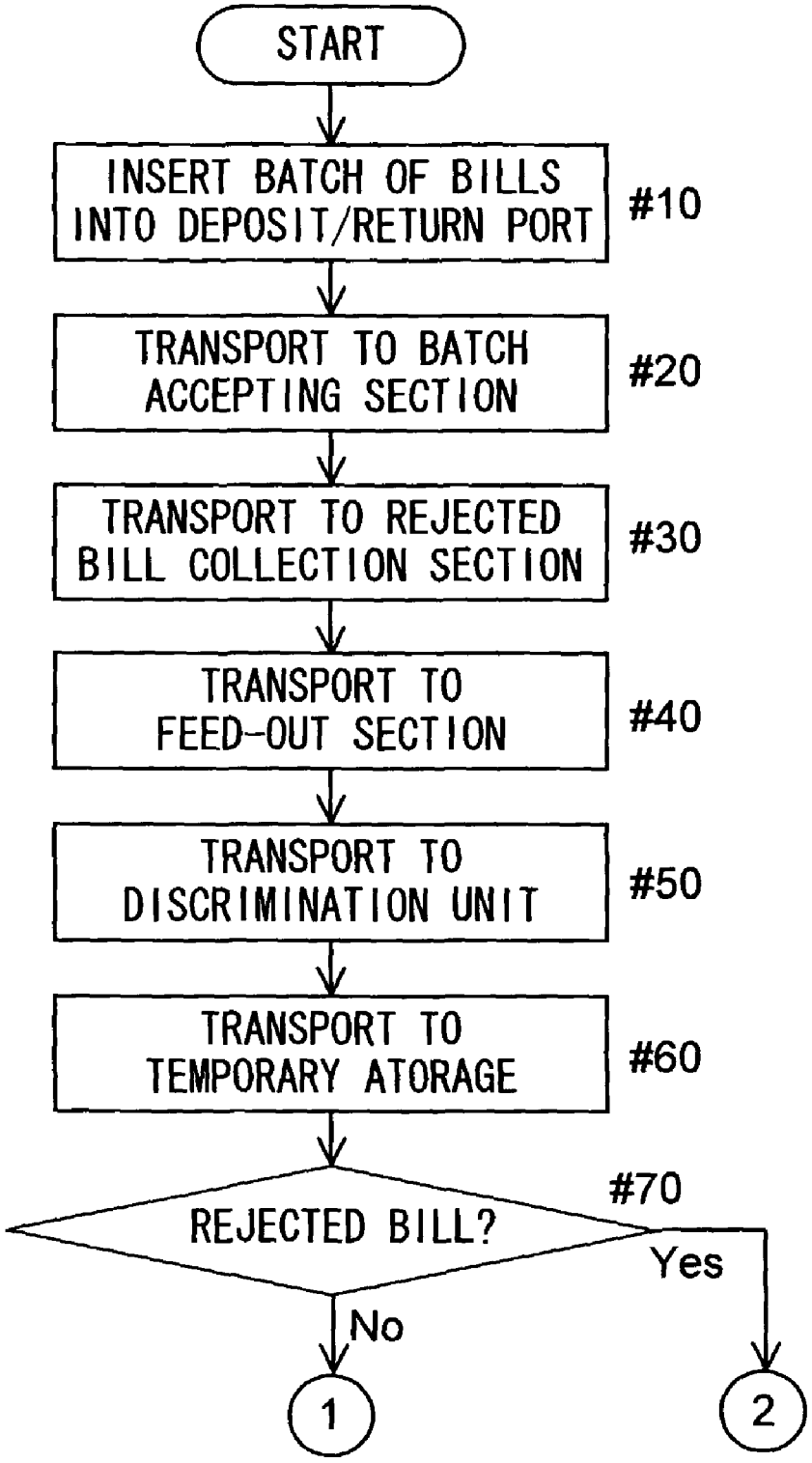
FIG. 9 is a flow chart showing a part of the procedure of the depositing operation performed by said bill deposit machine.
Figure 10:
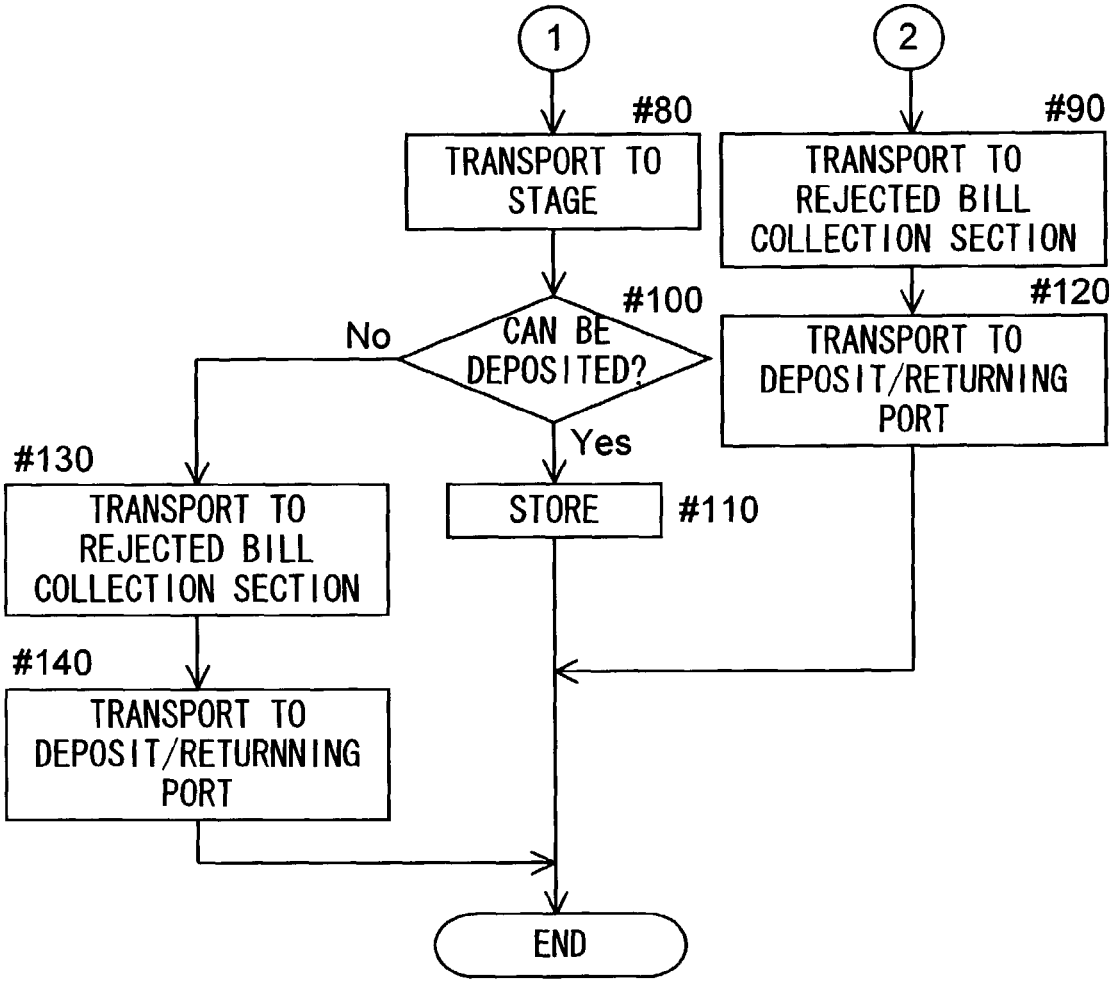
FIG. 10 is a flow chart showing the remaining part of the procedure of the depositing operation performed by the bill deposit machine.
Figure 11:
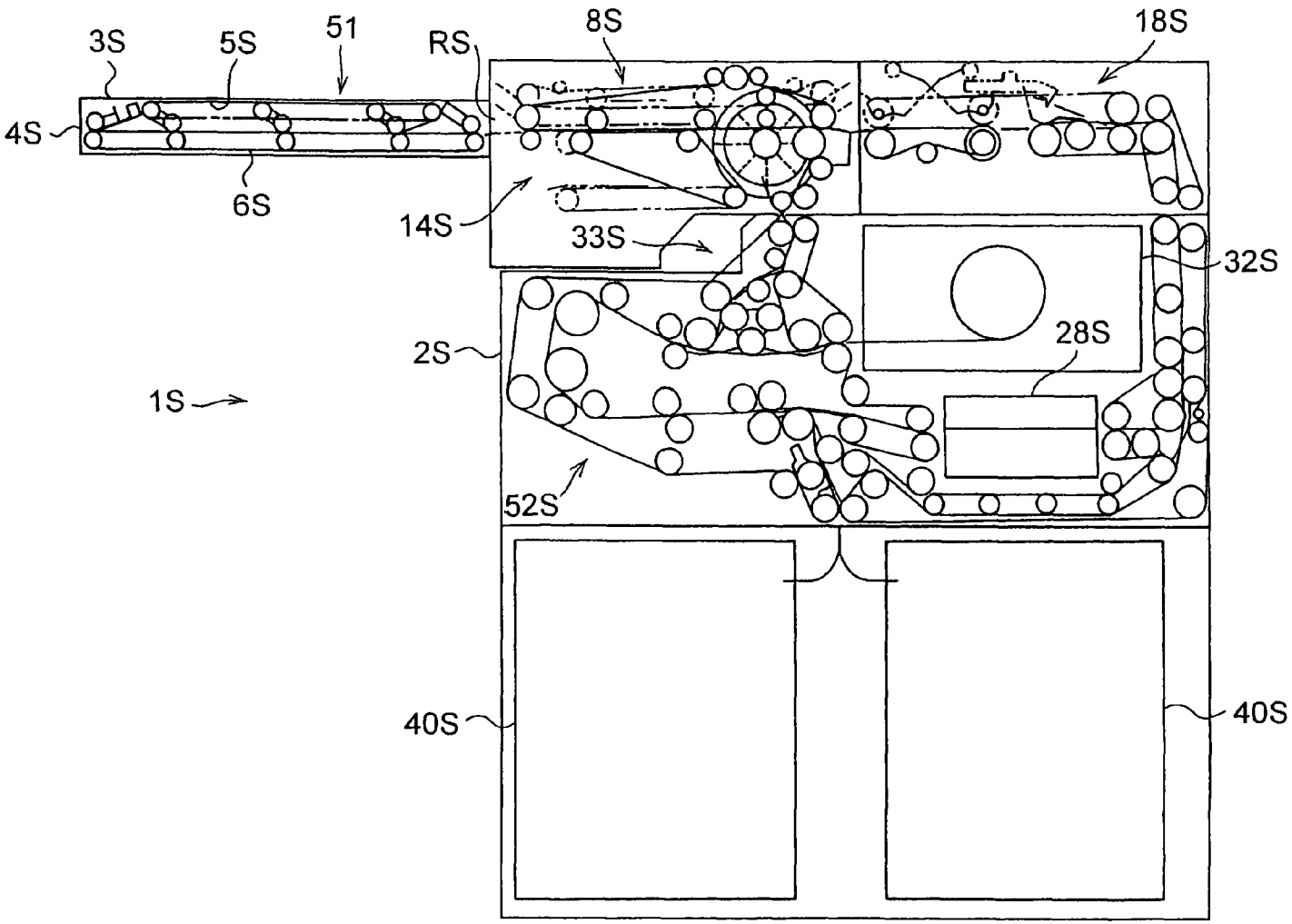
FIG. 11 is a vertical sectional view showing the outline of the bill deposit machine in accordance with the second embodiment of the present invention.

Now described is the motion of the bill deposit machine 1 according to the first embodiment with reference to the flow charts in FIGS. 9 and 10. When a customer inserts a batch of bills in the direction of the wide dimension of the bills into the deposit/return port 4 (Step #10) in the condition as shown in FIG. 2, the front end of the transport belt 6 goes down and the batch accepting section 8 moves to the lower end position, as shown in FIG. 3. The batch of bills is, then, sandwiched between the transport belts 5 and 6 and transported to the batch accepting section 8 by rotating the transport belts 5 and 6 (Step #20).

Figure 4:
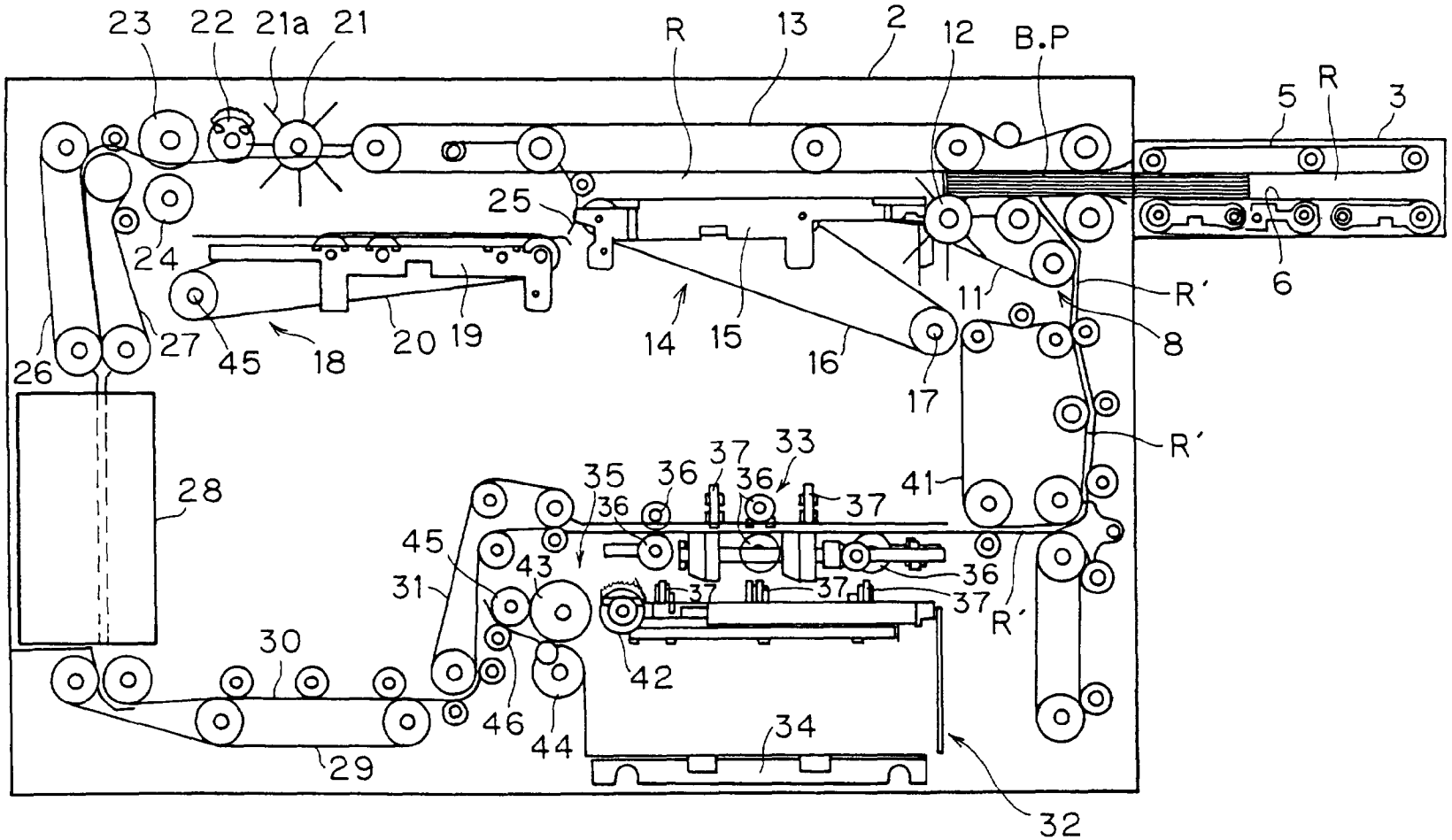
FIG. 4 is another vertical sectional view of said bill deposit machine showing the condition of a further different motion.

When the front end of the batch of bills comes to the batch accepting section 8, the batch accepting section 8 is raised as shown in FIG. 4. This makes the batch of bills B.P sandwiched between the transport belts 11 and 13. The stage 15 in the rejected bill collecting section 14 moves to the middle position. The batch of bills B.P is, then, transported to the rejected bill collecting section 14 with the transport belts 11 and 13 running (Step #30).

Figure 5:
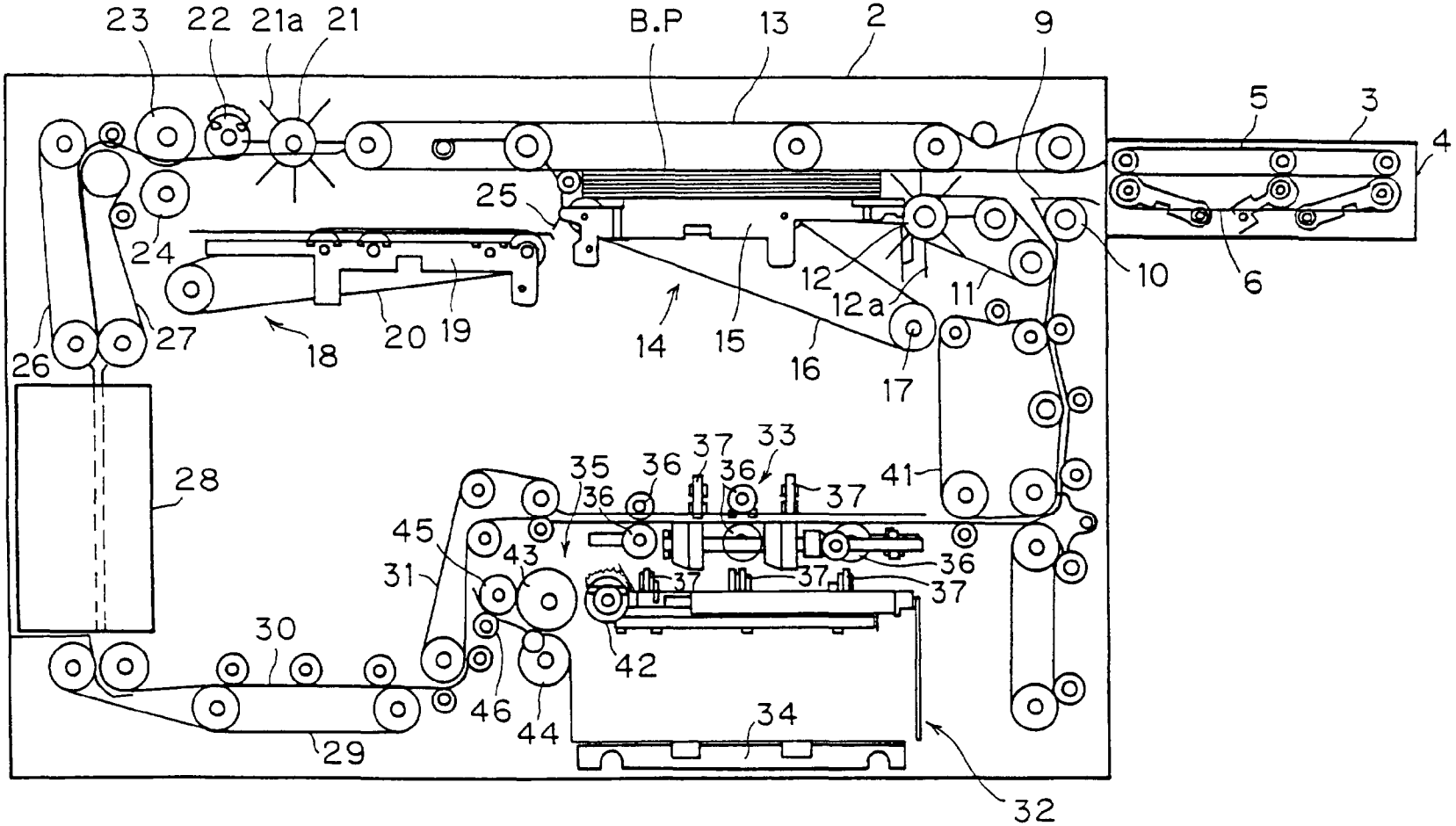
FIG. 5 is another vertical sectional view of said bill deposit machine showing the condition of a further different motion.

When the batch of bills B.P comes to the rejected bill collecting section 14, the stage 15 is raised as shown in FIG. 5. This makes the batch of bills B.P sandwiched between the transport belts 13 and 16 The stopper 25 then retracts from the transport path and the batch of bills B.P is transported to the feed-out section 18 with the transport belts 13 and 16 running (Step #40).

Figure 6:
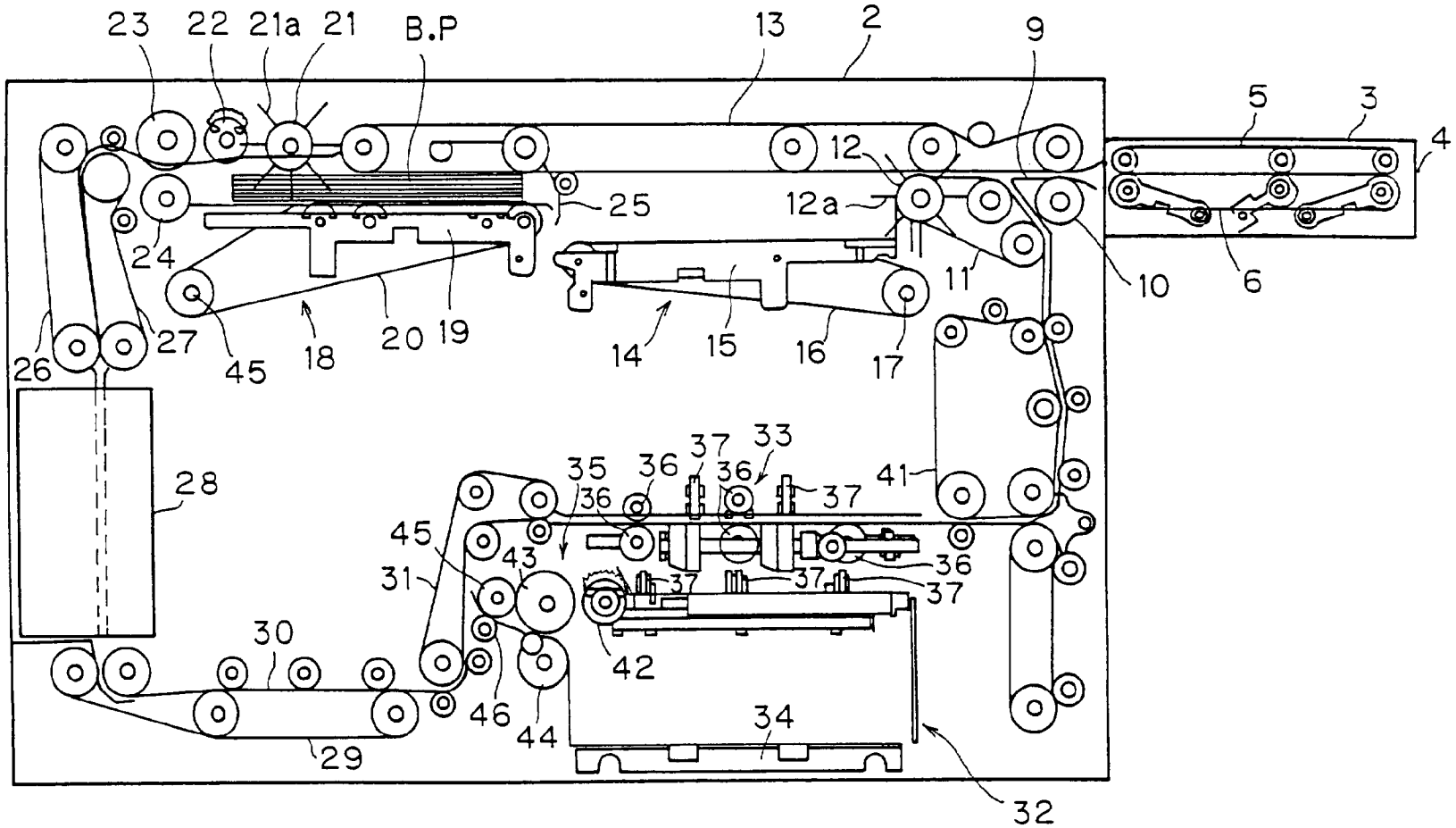
FIG. 6 is another vertical sectional view of said bill deposit machine showing the condition of a further different motion.

When the batch of bills B.P comes on about the half way to the specified position at the feed-out section 18, the stage 19 is raised. This makes the batch of bills B.P sandwiched between the transport belts 13 and 20. The batch of bills B.P is transported to the specified position with the transport belts 13 and 20 running. The stage 19 goes down, then goes up once again and stops at the height suitable for feeding out as shown in FIG. 6. The batch accepting section 8 moves to the higher end position, the stage 15 moves downward and the stopper 25 projects into the transport path.

The bill accumulated on the top of the batch of bills B.P is advanced to the opposite side of the customer with the impeller 21 rotating. The bill is transported toward the transport belts 26 and 27 with the kicker roller 22 and the feed roller 23 rotating, when the reverse roller 24 prevents the bills other than the bill on the top of the batch from being fed out. The bill is transported to the discriminating unit 28 by transport belts 26 and 27 (Step #50).

The discriminating unit 28 discriminates the denomination and the genuineness of the transported bill, of which result is stored in the memory of the control means. The bill which has passed through the discriminating unit 28 is transported to the temporary storage 32 by the transport belts 29-31 (Step #60). If the transported bill is a normal bill, the direction diverting mechanism 33 makes the bill transported to be on the stage 34 by the narrow dimension transport roller 37 (Steps #70 and #80).

Figure 7:
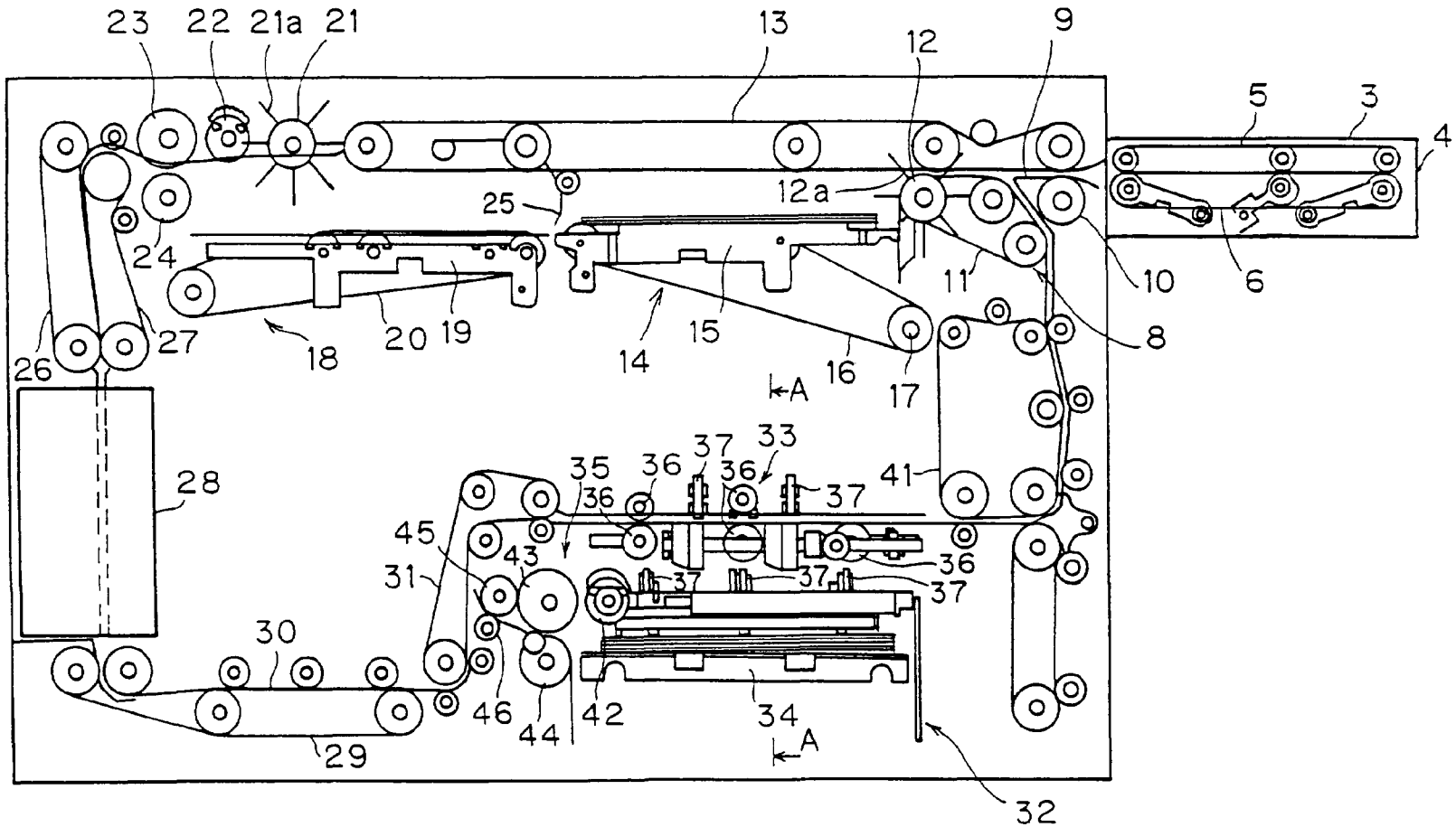
FIG. 7 is another vertical sectional view of said bill deposit machine showing the condition of a further different motion.

If the bill transported to the temporary storage 32 is a rejected bill, the direction diverting mechanism 33 makes the bill transported forward of the main body 2 of the machine by the wide dimension transport roller 36. The bill is transported to the rejected bill collecting section 14 through the bill returning path R' (Steps #70 and #90). FIG. 7 shows the condition that feeding out the bills from the feed-out section 18 is completed.

The sum total of the bills which can be deposited among the batch of bills inserted by the customer is displayed on the screen of an automatic teller machine, etc. disposed outside of the safe. When the customer inputs the information of approving the amount of the deposit by the operation panel, the stage 34 moves to the lowest position and then slides. The bills accumulated on the stage 34 drop into the bill storage box 40 and are stored, which means the completion of a depositing operation (Steps #100 and #110). On the other hand, the bills in the rejected bill collecting section 14 are transported to the deposit/return port 4 through the bill transport path R and returned to the customer through the deposit/return port 4 (Step #120).

When the amount of the bills which can be deposited is displayed on the screen of an automatic teller machine etc., the bills on the stage 34 are fed out by the feed mechanism 35 and transported to the rejected bill collecting section 14 through the direction diverting mechanism 33 and the bill returning path R' if the customer inputs the information of canceling the deposit by the operation panel. These bills are transported together with the rejected bills to the deposit/return port 4 through the bill transport path R and returned to the customer through the deposit/return port 4 (Steps #100, #130 and #140).

The bill deposit machine 1 according to the first embodiment inputs and outputs bills through one and only deposit/return port 4. It is, therefore, possible that only the deposit/return port 4 is designed to face the outside with only one small opening on the wall of a solidly-built structure such as a safe. This makes it extremely difficult to break the bill deposit machine 1 and steal the bills inside, which means that the machine has further improved burglarproof features.

In addition, in the bill deposit machine 1, the bill transport path R extending from the deposit/return port 4 to the feed-out section 18 is designed to transport the bills with the wide dimension of the bills parallel to the transport path horizontally and in a straight line. Therefore, the batch of bills is not curved, moreover, since the portion of the bill in contact with the transport mechanism is larger as compared with that in transporting bills with the narrow dimension of the bills parallel to the transport path, the bills are not easily separate from each other in the direction of transportation during transportation, enabling steady transportation. The bill transport path R may be seen in FIGS. 1 and 2, for example, to include a main-body-side part within the main body 2 and a projecting-portion-side part within the projecting portion or projecting part 2. The main-body-side part of bill transport path R extends from an entrance portion of the bill transport path R at the side of the main body connected to the projecting portion, and extends to the feed-out section 18. The projecting-portion-side part of bill transport path R extends from the deposit/return port 4 along the length of the projection part or projecting portion 3 to the entrance portion of the main-body-side part. The projecting-portion-side part of the bill transport path comprises a bill conveying device which includes transport belts 5 and 6, which feed bills between the deposit/return port 4 and the entrance portion of the bill transport path R at the side of the main body 2.

It is also possible to transport the rejected bills in the rejected bill collecting section 14 to the feed-out section 18 once again to discriminate in the discriminating unit 28. If this is put into practice, there are cases where the rejected bill is determined to be a normal bill at the second discrimination, thus, the possibility of rejecting the bills which can be deposited decreases. This eliminates the labor of inserting the rejected bills into the deposit/return port 4 once again by the customer for the purpose of discrimination.

The above explanation is given as to depositing the batch of bills. The same holds true with regard to depositing a single bill.

In the next place, the second embodiment of the present invention will be described by referring to the drawings, FIG. 11-FIG. 20. The basic constitution of the bill deposit machine according to the second embodiment does not greatly differ from that of the first embodiment. Only the differences between these two embodiments are the spatial dispositions of element blocks and the detailed structures. Therefore, the same reference numerals as used in the first embodiment are assigned to the constituent elements of the second embodiment when the constituent elements of the second embodiment are in common with those of the first embodiment in function and working. This can make the correspondence between the first and the second embodiments found easily.

Letter 'S' which means 'second' is prefixed to each number so that the second embodiment can be differentiated from the first embodiment.

The bill deposit machine 1S according to the second embodiment also has a projection part 3S, a rectangular parallelepiped, which projects forward of the upper front face of the main body 2S of the machine. A deposit/return port 4S is disposed at the end of the projection part 3S. Inside the projection part 3S, transport belts 5S and 6S are arranged to face each other in the upper and lower positions. Contrary to the first embodiment, the upper transport belt 5S can move vertically and can be freely in contact with and separate from the lower transport belt 6S. A bill conveying device 51 consists of the transport belts 5S and 6S. The batch of bills or a single bill inserted through the deposit/return port 4S is caught in the bill conveying device 51 and transported with the wide dimension of the bills parallel to the transport path horizontally and in a straight line.

Inside the main body 2S of the machine, a batch accepting section 8S is disposed adjacent to the bill conveying device 51. A bill transport path RS which transports a batch of bills or a single bill with the wide dimension of the bills parallel to the transport path horizontally and in a straight line consists of the batch accepting section 8S and the bill conveying device 51. Below the batch accepting section 8S, a rejected bill collecting section 14S is disposed.

A feed-out section 18S is disposed at the end of the bill transport path RS. The feed-out section 18S feeds out the bills, one at a time, out of the batch of bills received from the bill transport path RS and transports to a discriminating unit 28S.

The denomination and the genuineness of the transported bill are discriminated by the discriminating unit 28S. The discriminated bills are transported to a direction diverting mechanism 33S through a transport section 52S. The normal bills are transported to a temporary storage 32S and the rejected bills are transported to the rejected bill collecting section 14S by the direction diverting mechanism 33S.

When the discrimination of the batch of bills inserted by the customer is completely finished, the sum total of the bills which can be deposited is displayed on the screen of an automatic teller machine, etc. disposed outside of the safe. When the customer inputs the information of approving the amount of the deposit by the operation panel, the normal bills are taken out of the temporary storage 32S and dropped into a bill storage box 40S through the transport section 52S. The bill storage box 40S consists of two boxes, one for the main use and the other for the subordinate use. Or, these two boxes are used for storing the bills in different denominations separately.

The rejected bills and even the normal bills which are not instructed to be deposited by the customer are transported to the deposit/return port 4S through the bill transport path RS and returned to the customer through the deposit/return port 4S.

The bill deposit machine 1S according to the second embodiment has a thickness detecting device for detecting the thickness of the batch of bills and a takeout detecting device for detecting the movement of the bills which are being taken out of the deposit/return port 4S, both of which are disposed at the deposit/return port 4S.

Figure 12:
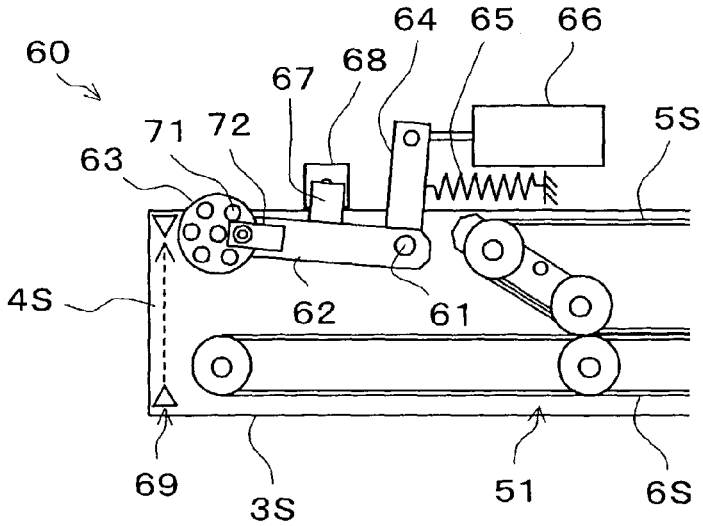
FIG. 12 is a partial vertical sectional view showing the structure of the thickness detecting device provided at the deposit/return port of the bill deposit machine in accordance with the second embodiment of the invention.
Figure 13:
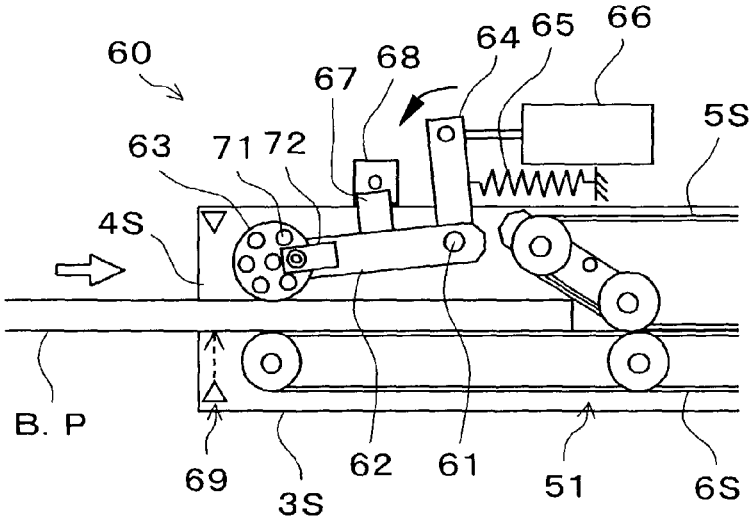
FIG. 13 is another partial vertical sectional view of said thickness detecting device showing the condition of a different motion.
Figure 14:
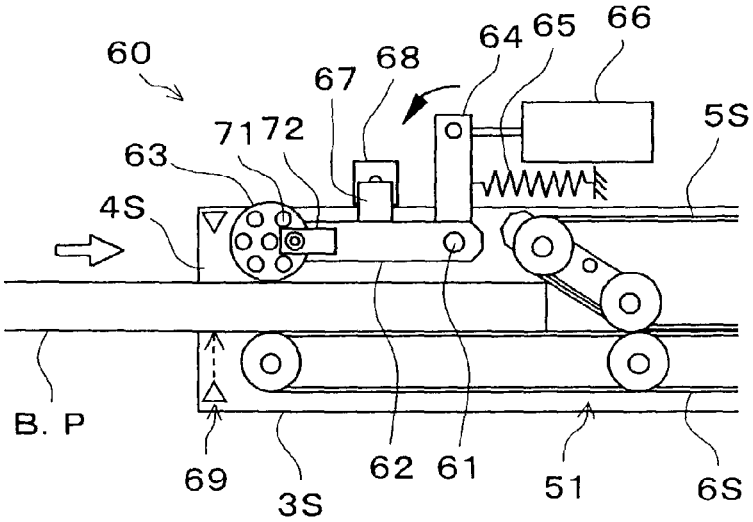
FIG. 14 is another partial vertical sectional view of said thickness detecting device showing the condition of a further different motion.

A thickness detecting device 60 will be described by referring to the drawings, FIG. 12-FIG. 14. The thickness detecting device 60 is comprised of the following elements: a lever 62 supported by a shaft 61 leveled with the projection part 3S to rotate vertically; a roller 63 which is supported to rotate freely at the movable end of the lever 62 and is in contact with the upper surface of the batch of bills inserted on the upper part of the transport belt 6S; a lever 64 fixed perpendicular to the lever 62; a spring 65, which is connected with the lever 64, for directing the levers 62 and 64 clockwise in the drawings; a solenoid 66, which is connected with the lever 64, for rotating the levers 62 and 64 counterclockwise against the spring 65 at the time of energizing; a light shield plate 67 fixed to the lever 62; a photo sensor 68 for monitoring the movement of the light shield plate 67; and an entrance sensor 69 for detecting the existence of bills at the deposit/return port 4S. The photo sensor 68 can either be of a transparent (photo-interrupter) type or of a reflective type. The entrance sensor 69 is a photo-interrupter type of photo sensor having a light emitting part and a light receiving part.

Figure 15:
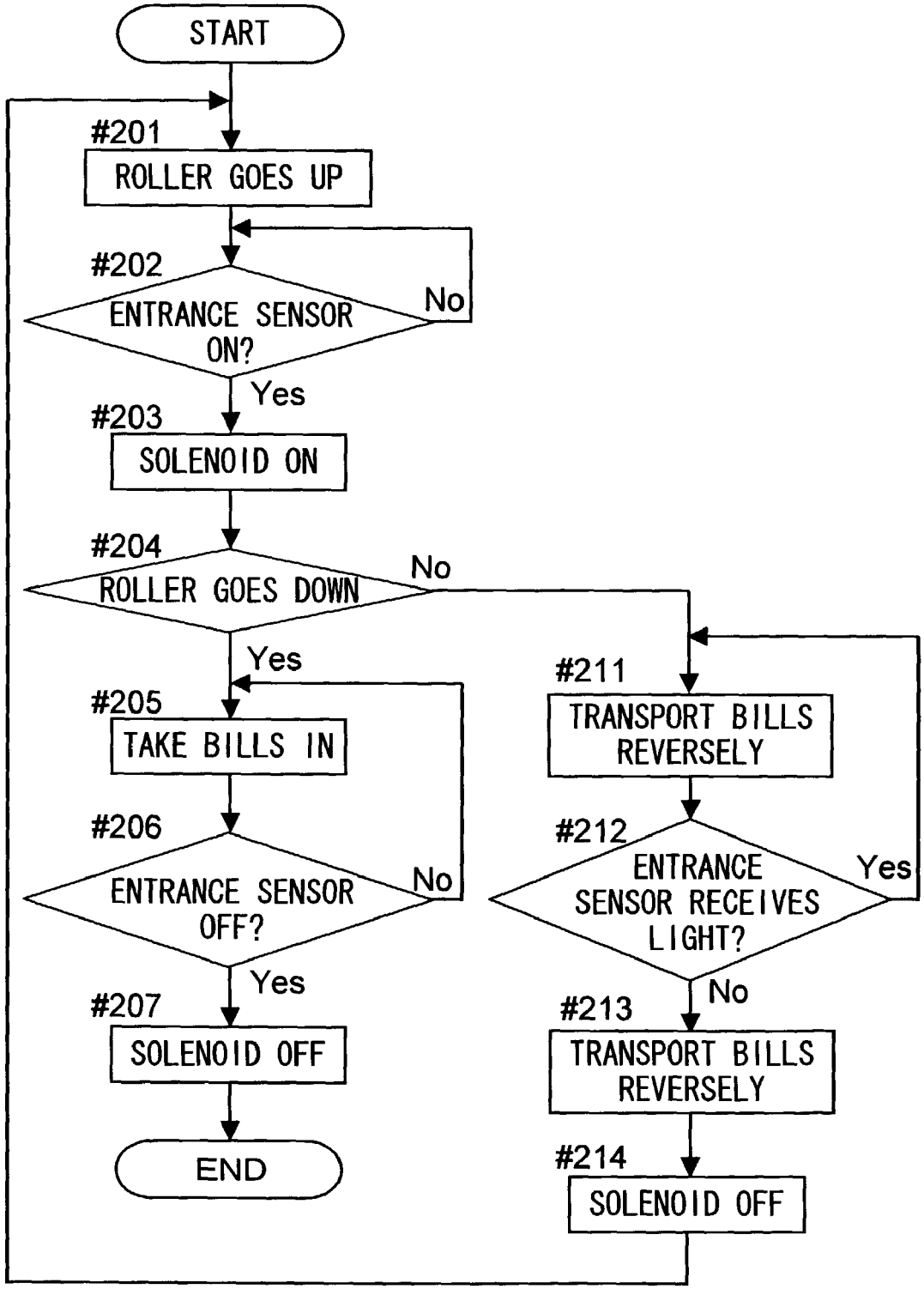
FIG. 15 is a flow chart showing the operation sequence of said thickness detecting device.

The motion of the thickness detecting device 60 is described with reference to the flow chart in FIG. 15. The lever 62 is always directed clockwise by the spring 65 and the angle is maintained where the lever 62 is in contact with a stopper (not illustrated). This usually makes the roller 63 at the raised position where the light shield plate 67 interrupts the photo sensor 68. This condition, which is shown in FIG. 12, corresponds to the Step #201 in the flow chart in FIG. 15.

The entrance sensor 69 always monitors if the batch of bills or a bill is at the deposit/return port 4S (Step #202). When the entrance sensor 69 detects the batch of bill B.P inserted at the deposit/return port 4S by the customer, that is, the entrance sensor 69 is in the status of interrupted light changed from in the status of received light, the solenoid 66 is energized (Step #203) and rotates the lever 62 counterclockwise against the spring 65. The roller 63 goes down to be in contact with the upper surface of the batch of bills B.P. This is the condition shown in FIG. 13.

Whether the roller 63 goes down lower than the specified value, that is, the thickness of the batch of bills B.P is within the permissible limit is determined by whether the photo sensor 68 is in the status of received light changed from in the status of interrupted light (Step #204). When the photo sensor 68 is in the status of received light because the light shield plate 67 is out of the ray of the photo sensor 68 as shown in FIG. 13, the Step #205 is conducted. When the photo sensor 68 remains to be in the status of interrupted light because the roller 63 does not go down enough due to the excessively thick batch of bills B.P as shown in FIG. 14, the Step #211 is conducted.

In the Step #205, as the thickness of the batch of bill B.P is within the permissible limit, the batch of bills B.P is taken in by the bill conveying device 51. The batch of bills B.P is transported to the batch accepting section 8S.

The entrance sensor 69 keeps on monitoring if the batch of bills B.P is at the deposit/return port 4S (Step #206). When the entrance sensor 69 no longer detects the existence of the batch of bill B.P, that is, the entrance sensor 69 is in the status of received light changed from in the status of interrupted light, which means the completion of the intake of the batch of bills B.P, the bill conveying device 51 stops and the solenoid 66 is not energized (Step #207). The roller 63 goes up to be in the status of waiting (idling).

If the batch of bills B.P is excessively thick and the Step #211 is conducted, the bill conveying device 51 rotates reversely and pushes the batch of bills B.P back to the customer. The reason why this is carried out is as follows. If the excessively thick batch of bills B.P is taken in, it falls like dominoes or falls and spreads as if a batch of cards is pushed from the side, during the transportation on the bill transport path RS, which causes the jam of bills. Whether the batch of bills B.P is taken out by the customer is determined by whether the entrance sensor 69 is in the status of received light changed from in the status of interrupted light (Step #212). In order to completely sweep out the bills which may be left on the transport path RS even after the batch of bills B.P is taken out, the motion of reverse transportation of bills continues for the specified period of time (Step #213). Then, the bill conveying device 51 stops and the solenoid 66 is not energized (Step #214). The roller 63 goes up to be in the status of waiting (idling).

Now described is a takeout detecting device 70 with reference to the drawings, FIGS. 16-19. The takeout detecting device 70 is comprised of the following elements added to the elements of the thickness detecting device 60. On the roller 63, a plurality of transparent holes 71 are disposed at intervals of the same angle on the arc of the circle concentric with the center of rotation. In the example in the drawing, the transparent holes 71 are six in number and disposed at intervals of sixty degrees. Photo sensor 72 shown in FIG. 19 reads the movement of the transparent holes 71 and detects the rotation of the roller 63. The photo sensor 72 is of a photo-interrupter type having a light emitting part 72*a* and a light receiving part 72*b*. The rotation of the roller 63 is read by the arrival of the light emitted from the light emitting part 72*a* to the light receiving part 72*b* through the transparent holes 71 or by interrupting the light by the area between the transparent holes 71. The photo sensor 72 installed to the lever 62 moves up and down together with the roller 63.

Figure 20:
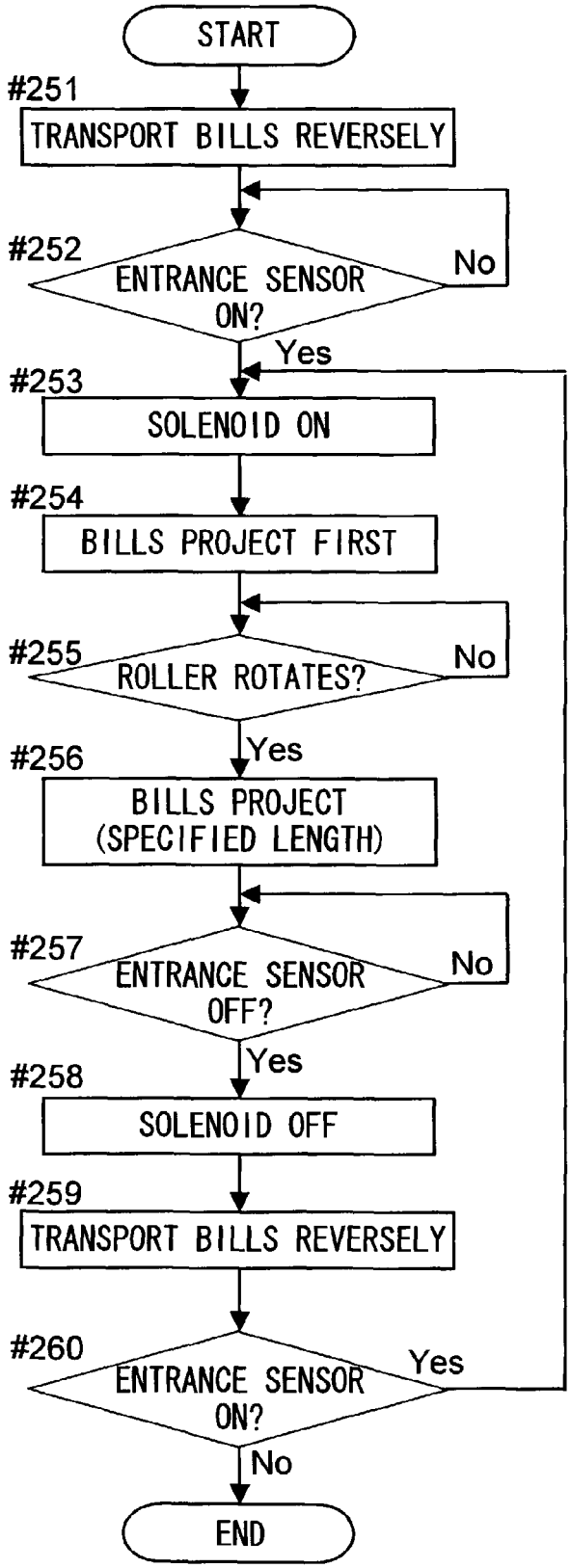
FIG. 20 is a flow chart showing the operation sequence of said takeout detecting device.

The motion of the takeout detecting device 70 and the motion of the bill conveying device 51 based on the motion of the former are described with reference to the flow chart in FIG. 20. As mentioned earlier, the lever 62 is directed clockwise by the spring 65 up to the position where the lever 62 is in contact with a stopper (not illustrated), and the roller 63 is at the raised position. The light shield plate 67 interrupts the photo sensor 68. This is the time when the rejected bills and the normal bills which are not instructed to be deposited by the customer are transported reversely on the bill transport path RS (Step #251).

Figure 16:
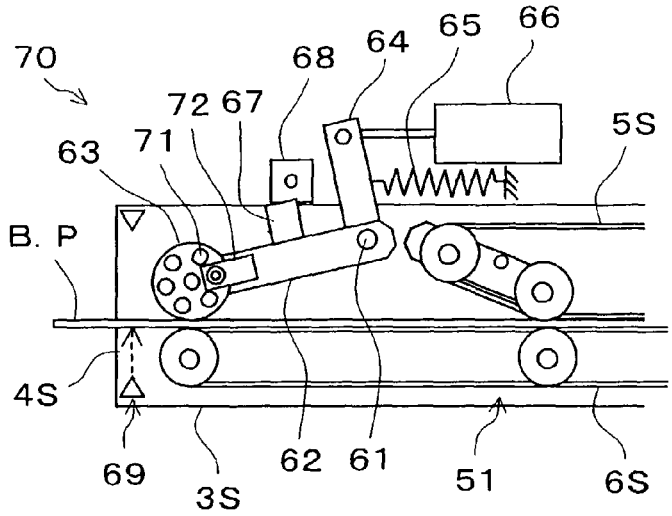
FIG. 16 is a partial vertical sectional view showing the structure of the takeout detecting device provided at the deposit/return port of the bill deposit machine in accordance with the second embodiment of the invention.

The entrance sensor 69 keeps on monitoring if the batch of bills or a bill reaches the deposit/return port 4S (Step #252). When the entrance sensor 69 detects the arrival of the batch of bills or a bill, that is, the entrance sensor 69 is in the status of interrupted light changed from in the status of received light, the solenoid 66 is energized (Step #253) and rotates the lever 62 counterclockwise against the spring 65. The roller 63 goes down to be in contact with the upper surface of the batch of bills or a bill. The bill conveying device 51 keeps on transporting reversely for a while even after the entrance sensor 69 generates a signal, and then stops when the batch of bills or a bill projects out of the deposit/return port 4S to such an extent that the bills can be held between the fingers. This condition, which is shown in FIG. 16, corresponds to the Step #254. FIG. 16 shows the condition of the projection of the batch of bills B.P, which has been transported reversely, from the deposit/retuning port 4S.

Figure 17:
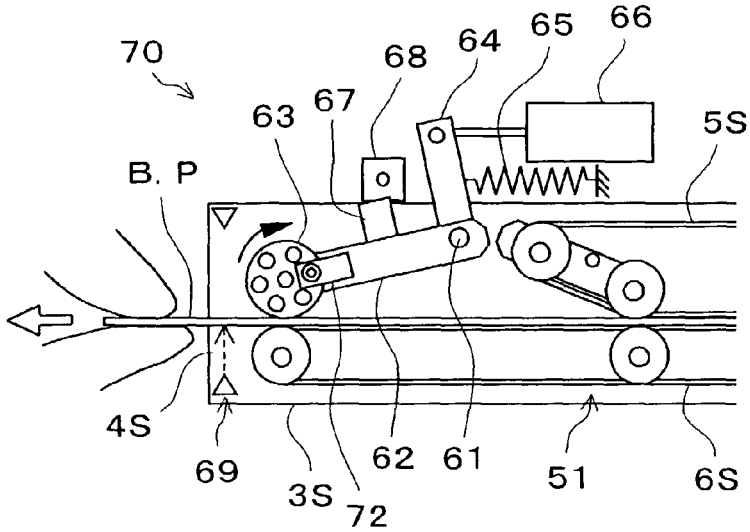
FIG. 17 is another partial vertical sectional view of said takeout detecting device showing the condition of a different motion.
Figure 18:
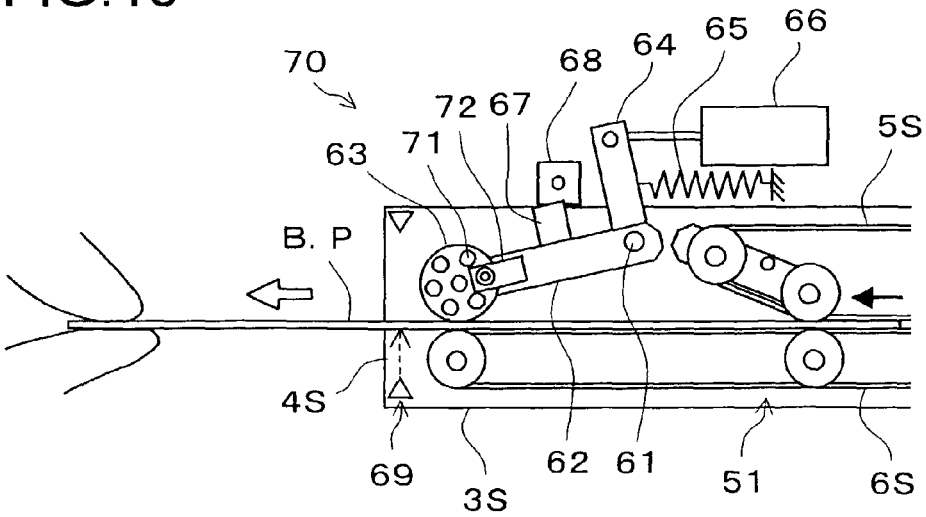
FIG. 18 is another partial vertical sectional view of said takeout detecting device showing the condition of a further different motion.
Figure 19:
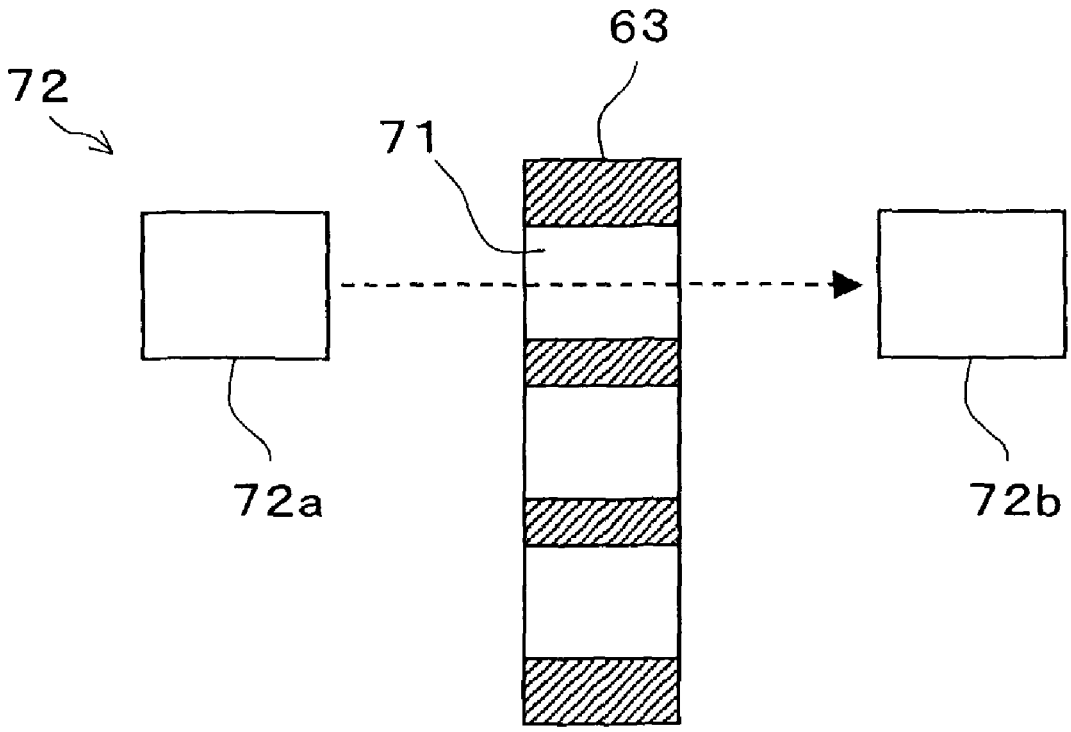
FIG. 19 is a schematic diagram showing the structure of said takeout detecting device in a section perpendicular to FIG. 16.

As the instruction of taking out the bills is displayed on the screen of an automatic teller machine, etc. accommodating the bill deposit machine 1, the customer tries to hold and take out the batch of bills B.P according to the instruction (refer to FIG. 17). The photo sensor 72 keeps on monitoring whether the roller 63 rotates (Step #255). When the photo sensor 72 detects the roller 63 rotating as the batch of bills B.P moves, the bill conveying device 51 further transports reversely the batch of bills B.P slightly to have said batch of bills B.P projected out of the deposit/return port 4S by the specified amount (Step #256). This is the condition of FIG. 18. The specified amount means the length of the batch of bills B.P projecting out of the deposit/return port 4S which can be held by the fingers but does not drop off the deposit/return port 4S even if the customer releases his hold of the batch of bills B.P or the wind blows at the time of taking out the batch of bills B.P because the opposite side of the bills is caught between the transport belts 5S and 6S.

The entrance sensor 69 keeps on monitoring if the batch of bills B.P is taken out of the deposit/return port 4S (Step #257). When the batch of bills B.P is taken out by the customer at the time of the condition shown in FIG. 18, the entrance sensor 69 is in the status of received light changed from in the status of interrupted light, thus, the solenoid 66 is not energized (Step #258). The roller 63 goes up.

Then, the bill conveying device 51 transports reversely once again to completely clear the bill transport path RS (Step #259). The entrance sensor 69 keeps on monitoring if the bills reach the deposit/return port 4S (Step #260). When the entrance sensor 69 detects the bills, which have not been taken out by the customer and are left on the bill transport path RS, transported reversely to the deposit/return port 4S, the next step goes back to the Step #253. If the entrance sensor 69 is not in the status of interrupted light even after the motion of reverse transportation of bills for the specified period of time, it is determined that the bill transport path RS is completely cleared, therefore, the reverse transportation is ended.

It is to be understood that this invention is not limited to the described embodiment and modifications and variations of the invention may be made without departing from the spirit and scope of the invention.

What is claimed is:

1. A bill deposit machine, comprising:

a main body;

a projecting portion that projects forward from said main body of said bill deposit machine, the projecting portion having a slender, long, rectangular shape;

a deposit/return port for accepting and returning a batch of bills located at a tip end of said projecting portion; and a bill transport path, along which the batch of bills, accepted by said deposit/return port, is transported in a straight line parallel to longer sides of the batch of bills, formed so as to run through an inside of said projecting portion into said main body, wherein, whereas the main body is isolated from a customer by a wall, the projecting portion extends through the wall so that access to the projecting portion by the customer is permitted only at a tip end of the projecting portion located on a side of the wall opposite from the customer, wherein, the main body is provided with, a main-body-side part of said bill transport path located inside the main body, a feed-out section feeding out one bill after another out of the batch of bills received from said bill transport path, a discriminating unit for discriminating whether bills fed out from said feed-out section can be deposited, a bill returning path along which bills that are found by said discriminating unit as unable to be deposited are, as rejected bills, transported back to said main-body-side part of said bill transport path, and a rejected bill collecting portion located directly between an entrance portion and said feed-out section in said main-body-side part of said bill transport path, and said rejected bill collecting portion, said entrance portion, and said feed-out section being arranged side-by-side horizontally adjacent each other, said rejected bill collecting portion and said feed-out section being totally within said main body, said rejected bill collecting portion accepting the bills taken into said bill transport path and, after feeding out by said feed-out section, accumulating and temporarily keeping the rejected bills transported thereto one by one along said bill transport path, a bill conveying device provided between said deposit/return port and said rejected bill collecting portion in said transport path, said bill conveying device conveying the bills taken into said transport path, and then feeding the bills to said rejected bill collecting portion, wherein said rejected bill collecting portion is raised to transport the accumulated rejected bills in a state sandwiched between said rejected bill collecting portion itself and a transport belt located above said rejected bill collecting portion, wherein, said main-body-side part of said bill transport path, said feed-out section, said discriminating unit, said bill returning path, and said rejected bill collecting portion are arranged such that the bills fed out from said feed-out section first return one by one through said bill returning path to a height of said transport belt located above said rejected bill collecting portion and are then collected in said rejected bill collecting portion, and inside said projecting portion is provided, as part of a projecting-portion-side part of said bill transport path located inside said projecting portion, a pair of transport belts that is shared for transport of the batch of bills accepted by said deposit/return port and for transport of said rejected bills from said rejected bill collecting portion back to said deposit/return port.

2. A bill deposit machine according to claim 1, wherein a temporary storage is provided to temporarily store the bills determined by said discriminating unit as being able to be deposited, and the bills in said temporary storage are transported to said rejected bill collecting portion when a depositing transaction is cancelled.

3. A bill deposit machine according to claim 1, wherein the rejected bills in said rejected bill collecting portion are retransported to said feed-out section to be discriminated by said discriminating unit.

4. A bill deposit machine according to claim 1, further comprising:

an entrance sensor that detects whether the bill is present at the deposit/return port;

a thickness detecting device, provided adjacent to the entrance sensor, for detecting the thickness of the batch of bills inserted into said deposit/return port, wherein the thickness detection device detects the thickness of the batch of bills when the entrance sensor detects that the bill is present at the deposit/return port, the batch of bills is not taken in by said pair of transport belts if the batch of bills is detected to be over the specified value in thickness by said thickness detecting device.

5. A bill deposit machine according to claim 1, further comprising:

an entrance sensor that detects whether the bill is present at the deposit/return port; and a takeout detecting device for detecting the movement of the bills at said deposit/return port, wherein, said pair of transport belts projects the bill from the deposit/return port and prevents the bill from falling off from the deposit/return port until said takeout detecting device and said entrance sensor detect that the bill have been completely taken out of said deposit/return port.

6. A bill deposit machine according to claim 5, wherein, when said takeout detecting device detects that the bills are being pulled out but said entrance sensor detects that the bill is still present at the deposit/return port, said pair of transport belts further projects the bill and keeps the bill projected by an additional specified amount.

7. A bill deposit machine, comprising:

a main body;

a deposit/return port for accepting and returning a batch of bills;

a bill transport path, along which the batch of bills accepted by said deposit/return port is transported in a straight line parallel to longer sides of the batch of bills;

a feed-out section provided at an end of said bill transport path, the feed-out section feeding out one bill after another out of the batch of bills received from said bill transport path;

a discriminating unit for discriminating whether bills fed out from said feed-out section can be deposited;

a bill returning path along which bills that are found by said discriminating unit as unable to be deposited are, as rejected bills, transported back to said bill transport path; and a rejected bill collecting portion provided between said deposit/return port and said feed-out section in said bill transport path, said rejected bill collecting portion accepting the bills taken into said bill transport path and, then feeding the bills to said feed-out section, a bill conveying device provided between said deposit/return port and said rejected bill collecting portion in said transport path, said bill conveying device conveying the bills taken into said transport path, and then feeding the bills to said rejected bill collecting portion, wherein said deposit/return port, said conveying device, said rejected bill collecting portion, and said feed-out section are arranged horizontally, wherein said bill transport path, said feed-out section, said discriminating unit, said bill returning path, and said rejected bill collecting portion are arranged such that the bills fed out from the feed-out section are first returned one by one through said bill returning path to a height of a top face of the bill transport path and are then collected in said rejected bill collecting portion to be temporarily stocked therein.

* * * * *